US006489011B2

(12) United States Patent
Uegaki

(10) Patent No.: US 6,489,011 B2
(45) Date of Patent: Dec. 3, 2002

(54) METHOD OF REPAIRING A VEHICLE BODY, METHOD OF CALCULATING AMOUNT OF A REPAIR WORK, AND SHEET FOR REPAIRING VEHICLE BODY

(75) Inventor: Tateo Uegaki, 2-21, Turugaya 7-chome Miyagino-ku, Sendai-shi, Miyagi (JP)

(73) Assignee: Tateo Uegaki, Sendai (JP)

( * ) Notice: Subject to any disclaimer, the term of this patent is extended or adjusted under 35 U.S.C. 154(b) by 0 days.

(21) Appl. No.: 09/911,095

(22) Filed: Jul. 23, 2001

(65) Prior Publication Data

US 2002/0022119 A1 Feb. 21, 2002

Related U.S. Application Data

(62) Division of application No. 09/434,002, filed on Nov. 4, 1999.

(30) Foreign Application Priority Data

Nov. 5, 1998 (JP) ..... 10-315185
Nov. 5, 1998 (JP) ..... 10-315186

(51) Int. Cl.[7] ..... B32B 3/02

(52) U.S. Cl. ..... 428/195; 428/99; 428/66.5

(58) Field of Search ..... 428/195, 99, 66.5; 29/402.19

(56) References Cited

U.S. PATENT DOCUMENTS 1,542,432 A * 6/1925 Wilson ..... 428/66.5
2,946,118 A 7/1960 Steck
3,187,538 A 6/1965 Painter

FOREIGN PATENT DOCUMENTS

DE 296 15 666 2/1997
JP 2-12601 7/1988
JP 11078807 3/1999

* cited by examiner

*Primary Examiner*—Alexander S. Thomas
(74) *Attorney, Agent, or Firm*—Burr & Brown

(57) ABSTRACT

A sheet for a repair work of a vehicle body including points distributed by providing a central part as an origin or a cardinal point and area display parts for dividing stepwise the respective points into a plurality of areas from the central part toward outer parts. The respective points indicate pulling-out work positions and the respective areas divided by the area display parts indicate the sequence of pulling-out works. This allows the damaged part of the outside plate panel of a vehicle to be repaired in a short time.

4 Claims, 12 Drawing Sheets

METHOD OF REPAIRING A VEHICLE BODY, METHOD OF CALCULATING AMOUNT OF A REPAIR WORK, AND SHEET FOR REPAIRING VEHICLE BODY

CROSS REFERENCE TO RELATED APPLICATION

This is a divisional application of Ser. No. 09/434,002, filed Nov. 4, 1999, the entirety of which is incorporated herein by reference.

BACKGROUND OF THE INVENTION

1. Field of the Invention

The present invention relates to a method of repairing a vehicle body, and more particularly to a method of repairing the damage of the outside plate panel of a vehicle such as a motor vehicle and a method of calculating the amount of a repair work.

Further, the present invention relates to a tool to be used for the repair work of a vehicle, and more particularly, to a tool employed when the damage of the outside plate panel of a vehicle is repaired.

2. Description of the Related Art

In order to repair dents on the outside plate panel of a vehicle such as a motor vehicle, there is conventionally known a vehicle repairing method in which the panel is struck out for repair from the back side of a damaged part by a hammer or the like, or a vehicle repair work in which steel washers or pins are electrically welded to the surface of a damaged part and the washers or pins welded to the surface are pulled out using a tool so as to repair the panel.

For example, according to the method of repairing the vehicle by pulling out the washers or pins, after the coat film of the damaged part is stripped, many washers are electrically welded to the surface of the damaged part by a washer welding machine, and a hook at the end of a slide hammer is engaged with the washers welded to the surface of the damaged part so that the panel of the part to which the washers are welded is pulled out or drawn out under the impact force of the slide hammer.

However, according to the above described method of pulling out washers, a part to be pulled out, in other words, a place to which the washers are welded has been set on the basis of the experience of an operator. Therefore, the place to which the washers are welded and the number of washers to be welded for the same damage have been different between operators because of the difference in experience of the operators. As described above, it has been difficult for all operators to desirably set a place to be pulled out which is most suitable for a repair work. Particularly, it has been very difficult for an operator having little experience to set a position to be pulled out, and hence the number of welded washers has been apt to be excessively increased, resulting in increase of a work time.

Further, according to an ordinary panel pulling out process for a repair, the central part of a dent in a damaged part which is most badly recessed is first pulled out, and then, the remaining part or the edge part of the dent is pulled out to repair a panel. However, if the central part of the dent is first pulled out, the central part may possibly swell or expand when the edge part of the dent is pulled out later. This phenomenon occurs because of a fact that the previous panel pulling work at the central part of the damaged part is excessively carried out. Generally, it has been very hard to adjust the panel pulling-out work in the central part of the damaged part. Consequently, the repair work has been undesirably increased.

Further, as a pretreatment of the panel pulling-out work, the coat film of a damaged part needs to be stripped therefrom. The stripping work of the coat film is liable to be carried out within a wider area. Since, in the case where it is decided that the stripping work of the coat film needs to be further carried out once the stripping work of the coat film is finished to shift to a subsequent panel pulling-out work, it is extremely troublesome to return to the stripping work of the coat film, the stripping work of the coat film is carried out in a wider area. However, when the coat film-is stripped within a wider area, it disadvantageously takes time more than necessary for a coat film stripping work itself. In addition, a restoring material such as a putty or a paint and repairing time must be consumed in order to restore the surface of the panel from which the coat film is stripped.

As described above, upon repair of a damaged part, a work area, the amount of materials to be used and work time, which is required to repair the same damage, will be different depending on the operators. Therefore, it has been hitherto impossible to previously calculate a detailed amount of work such as a work area or work time or the like.

SUMMARY OF THE INVENTION

Accordingly, it is an object of the present invention to provide a repairing method and a repairing tool liable to repair the damaged part of the outside plate panel of a vehicle in a short time. Further, it is another object of the present invention to provide a repairing method and a repairing tool by which even an operator having little experience can readily and assuredly repair the damaged part of the outside plate panel of a vehicle.

Further, it is another object of the present invention to provide a repairing method and a repairing tool by which the damaged part of the outside plate panel of a vehicle can be repaired at low cost.

Furthermore, it is still another object of the present invention to provide a calculating method of previously calculating the amount of work necessary for a repair work of the damaged part of the outside panel of a vehicle.

According to a first aspect of the present invention, the above described objects can be achieved by providing a method of repairing the damage of a panel of a vehicle body comprising the steps of: (a) marking points at a damaged part of the panel, which are distributed in a range from the central part to the outer edge parts of the damaged part; and (b) pulling out the panel at the marked points successively from the outer points to the inner points of the points.

Each of a plurality of points belongs to any of a plurality of areas extending stepwise from the central part to the outer edge parts of the damaged part in the step (a) and, after the panel is pulled out at the respective points of the outer areas, the panel can be pulled out in the respective points of the inner areas in the step (b).

Further, each of a plurality of points can be located within a prescribed distance from the boundary of the respective areas in the step (a).

Further, the points can be divided into first points essentially requiring a pulling-out work and second points requiring a supplementary pulling -work in the step (a).

Still further, the method further comprises, between the steps (a) and (b), a step (c) of stripping a coat film located within a range surrounded by an outer peripheral line for connecting the outermost points together.

According to a second aspect of the present invention, the above described objects can be achieved by providing a method of repairing the damage of a panel of a vehicle body comprising the steps of: (a) marking points at a damaged part of the panel, ranging from the deepest part to the shallowest part of the damaged part of the panel; and (b) pulling out the panel at the points successively from the shallowest point to the deepest point of a plurality of points.

According to a third aspect of the present invention, the above mentioned object can be attained by providing a method of calculating the amount of a repair work of a vehicle body in which time necessary for a repair work of a vehicle body is calculated, the method comprising the steps of: (a) marking pulling-out points of a damaged part at prescribed intervals in the damaged part of the panel of the vehicle body; (b) counting the number of points marked in the step (a); and (c) calculating time necessary for a repair work in the damaged part by multiplying the points counted in said step (b) by prescribed time.

According to a fourth aspect of the present invention, the above described object can be realized by providing a method of calculating the amount of a repair work of a vehicle body in which a work area for repairing the vehicle body is calculated, the method comprising the steps of: (a) marking pulling-out points of a damaged part at prescribed intervals in the damaged part of a panel; a step (b) of calculating the points marked in the step (a); and (c) calculating the work area for the repair work in the damaged part of the vehicle body by multiplying the points calculated in the step (b) by a prescribed area.

Further, according to a fifth aspect of the present invention, the above described objects can be achieved by providing a sheet for repairing the damage of a panel of a vehicle comprising: points distributed by providing a central part as an origin or a cardinal point; and area display parts for dividing stepwise the respective points into a plurality of areas from the central part toward outer parts, wherein the respective points indicate pulling-out work positions and the respective areas divided by the area display parts indicate the sequence of pulling-out works.

In the fifth aspect of the present invention, each point can be located within a prescribed distance from the boundary of the respective areas. Besides, each boundary can be formed by a broken line.

Further, the sheet is made of a transparent or translucent material.

Still further, the sheet of the present invention is provided with fixing means for fixing the sheet to the panel of a vehicle body.

According to the present invention, when the points are marked on the damaged part of a vehicle body, the following manner may be carried out by way of example. 1. the points are previously printed on a transparent or a translucent sheet, and the sheet having the points marked thereon is stuck to the damaged part of the vehicle body, so that the points can be marked. In this case, when the sheet is fixed to the damaged part of the vehicle body, the sheet may be stuck to the vehicle body by an adhesive agent, or a magnet may be used to sandwich the sheet between the magnet and the vehicle body.

Otherwise, 2. a sheet on which the points are punched out is prepared, and a paint (for instance, spray painting) is applied to the surface of the sheet while the above described sheet abuts on the damaged part, so that the points can be marked on the damaged part. Further, 3. a light may be irradiated to a part on which the points of the damaged part are to be marked, so that the points can be marked on the damaged part.

As for the point marks in the case of the above described 1, a thin sheet can be employed. This sheet includes points or boundaries of areas which are printed on a transparent sheet made of a synthetic. Specifically, on the sheet, four areas which extend radially from the central part as an origin can be formed. The four areas include, from the outside, a first area located between a first boundary (a circumferential line) and a second boundary, a second area located between the second boundary and a third boundary, a third area between the third boundary and a fourth boundary and a fourth area located inside the fourth boundary. The above described boundaries may be formed with concentric circles having the central point, respectively.

While many points are printed in the respective areas, these points can be classified into two kinds of points, i.e., first points and second points. The first points are located within a first prescribed distance (for instance, 5mm) inside from each boundary, and the second points are located within a second prescribed distance (for instance, 20 mm) inside from each boundary.

The first points can be arranged at regular intervals (for instance, intervals of 15 mm in a straight line therebetween in the circumferential direction. Further, the second points may be arranged at regular intervals (for instance, intervals of 25 mm in a straight line) therebetween in the circumferential direction, which are slightly larger than those between the first points.

The first points indicate points at which an operator must carry out a pulling-out work, and the second points indicate points at which the operator may selectively carry out a pulling-out work in accordance with the progress of the pulling work.

Further, on the sheet are displayed four corner parts within each corresponding boundary. Then, the reach inside the four first corner parts corresponding to the first boundary can be set to designate, for example, 4 $dm^2$ (1 $dm^2$=10 cm×10 cm). The reach inside the four second corner parts corresponding to the second boundary can be set to designate, for instance, 2.25 $dm^2$. The reach inside the four third corner parts corresponding to the third boundary can be set to indicate, for instance, 1 $dm^2$. The reach inside the four fourth corner parts corresponding to the fourth boundary can be set to indicate, for instance, 0.25 $dm^2$.

Further, any thickness of the sheet may be employed without a special limitation; however, it is desired to employ a thinner sheet in view of the feature of a work. As to the quality of a material of the sheet, a plastic film or a cellophane sheet (preferably moisture-proof cellophane) may be preferably employed. A sheet such as wood free paper, medium quality paper, etc. which is formed by blending a chemical pulp and a mechanical pulp together may be utilized. Thus, the respective points or boundaries, etc. are printed on a sheet such as a plastic film to form a sheet.

Further, if there are formed a plurality of areas, any number of areas may be formed.

Therefore, according to the present invention, the damaged part of the outside plate panel of a vehicle can be assuredly repaired in a short time.

Further, even an operator having little experience can readily and effectively repair the damaged part of the outside plate panel of a vehicle.

Still further, the damaged part of the outside plate panel of a vehicle can be repaired at low cost.

Furthermore, according to the present invention, the amount of a repair work for repairing the damaged part of the outside plate panel of a vehicle can be previously calculated.

Other features and advantages of the present invention will be apparent from the following description taken in conjunction with the accompanying drawings.

DETAILED DESCRIPTION OF THE PREFERRED EMBODIMENTS

Now, the present invention will be described in more detail hereinafter.

Here, a method of repairing a vehicle body will be mainly described by way of an example that a substantially circular dent is generated in an outside plate panel.

Figure 1:
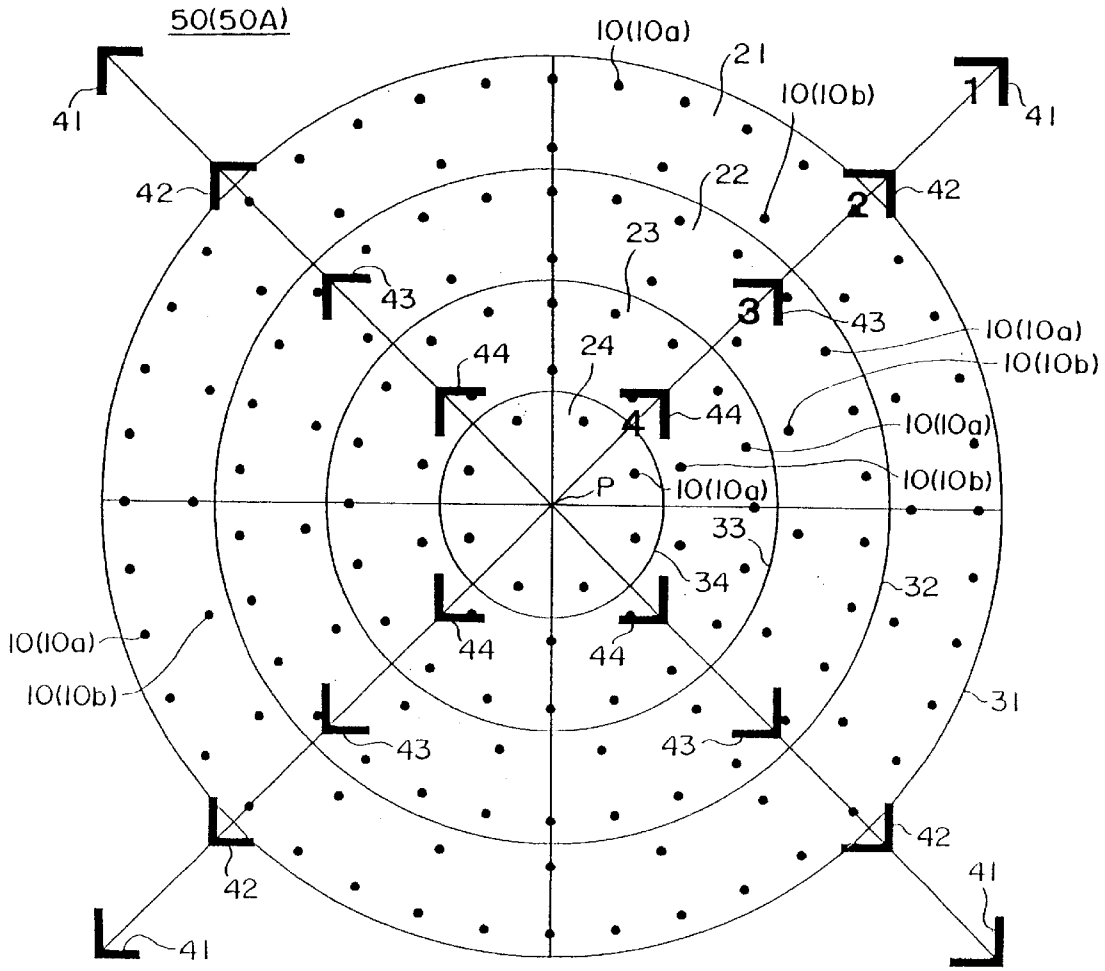
FIG. 1 is a view showing a sheet corresponding to a circular damage which is used for a repair work according to one embodiment of the present invention.
Figure 8:
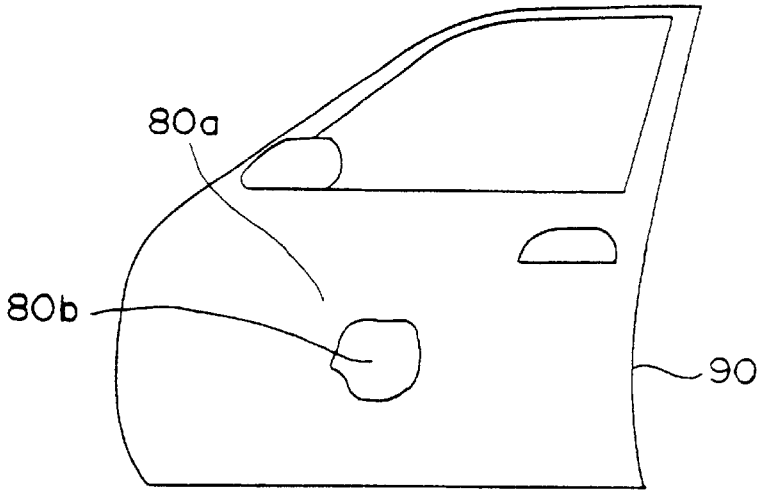
FIG. 8 is a view showing the door panel of a vehicle body to be repaired by a repair work according to one embodiment of the present invention.

As illustrated in FIG. 8, a damage 80*b* is generated in a door panel 90. Since this damage 80*b* has a substantially circular shape, a sheet 50A shown in FIG. 1 serving as an instruction sheet of pulling-work points for a circular damage is prepared.

[Structure of Sheet]

This sheet 50A includes points and boundaries of areas which are printed on a transparent sheet made of a synthetic resin. On the sheet 50A, four areas radially extend with a central point P as an origin. The four areas include, from the outside part, a first area 21 located between a first boundary (a circumferential line) 31 and a second boundary 32, a second area 22 located between the second boundary 32 and a third boundary 33, a third area 23 located between the third boundary 33 and a fourth boundary 34 and a fourth area 24 located inside the fourth boundary 34. The above described boundaries 31, 32, 33 and 34 may form concentric circles having the center P, respectively.

While many points are printed in the respective areas 21, 22, 23 and 24, these points can be classified into two kinds of points, i.e., first points 10*a* and second points 10*b*. The first points 10*a* are located within a first prescribed distance (for instance, 5mm) inside from the respective boundaries 31, 32, 33 and 34, and the second points 10*b* are located within a second prescribed distance (for instance, 20 mm) inside from the respective boundaries 31, 32 and 33.

The first points 10*a* are arranged at regular intervals (for instance, at intervals of 15 mm) therebetween in the circumferential direction. Further, the second points 10*b* may be arranged at regular intervals (for instance, at intervals of 25 mm) therebetween in the circumferential direction, which are slightly larger than those between the first points 10*a*.

The first points 10*a* indicate points at which an operator must necessarily carry out a pulling-out work, and the second points 10*b* indicate points at which the operator may selectively carry out a pulling-out work in accordance with the progress of the pulling-out work.

Further, on the sheet 50A are displayed four corner parts each corresponding boundary. Then, the reach inside the four first corner parts 41, 41, 41, and 41 corresponding to the first boundary 31 designates 4 $dm^2$. The reach inside the four second corner parts 42, 42, 42 and 42 corresponding to the second boundary 32 designates 2.25 $dm^2$. The reach inside the four third corner parts 43, 43, 43 and 43 corresponding to the third boundary 33 indicates 1 $dm^2$. The reach inside the four fourth corner parts 44, 44, 44 and 44 corresponding to the fourth boundary 34 indicates 0.25 $dm^2$.

Figure 2:
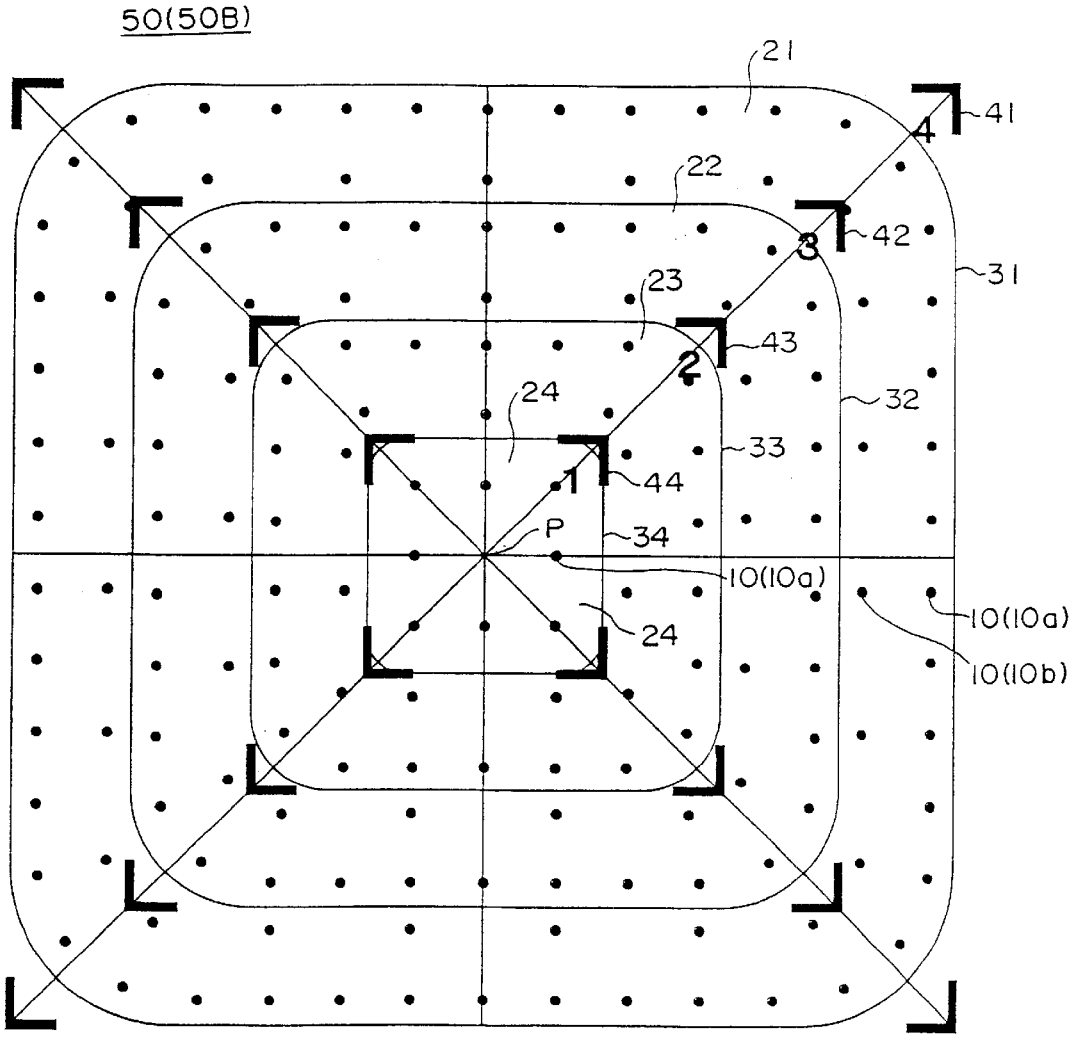
FIG. 2 is a view showing a sheet corresponding to a square damage which is used for a repair work according to one embodiment of the present invention.
Figure 3:
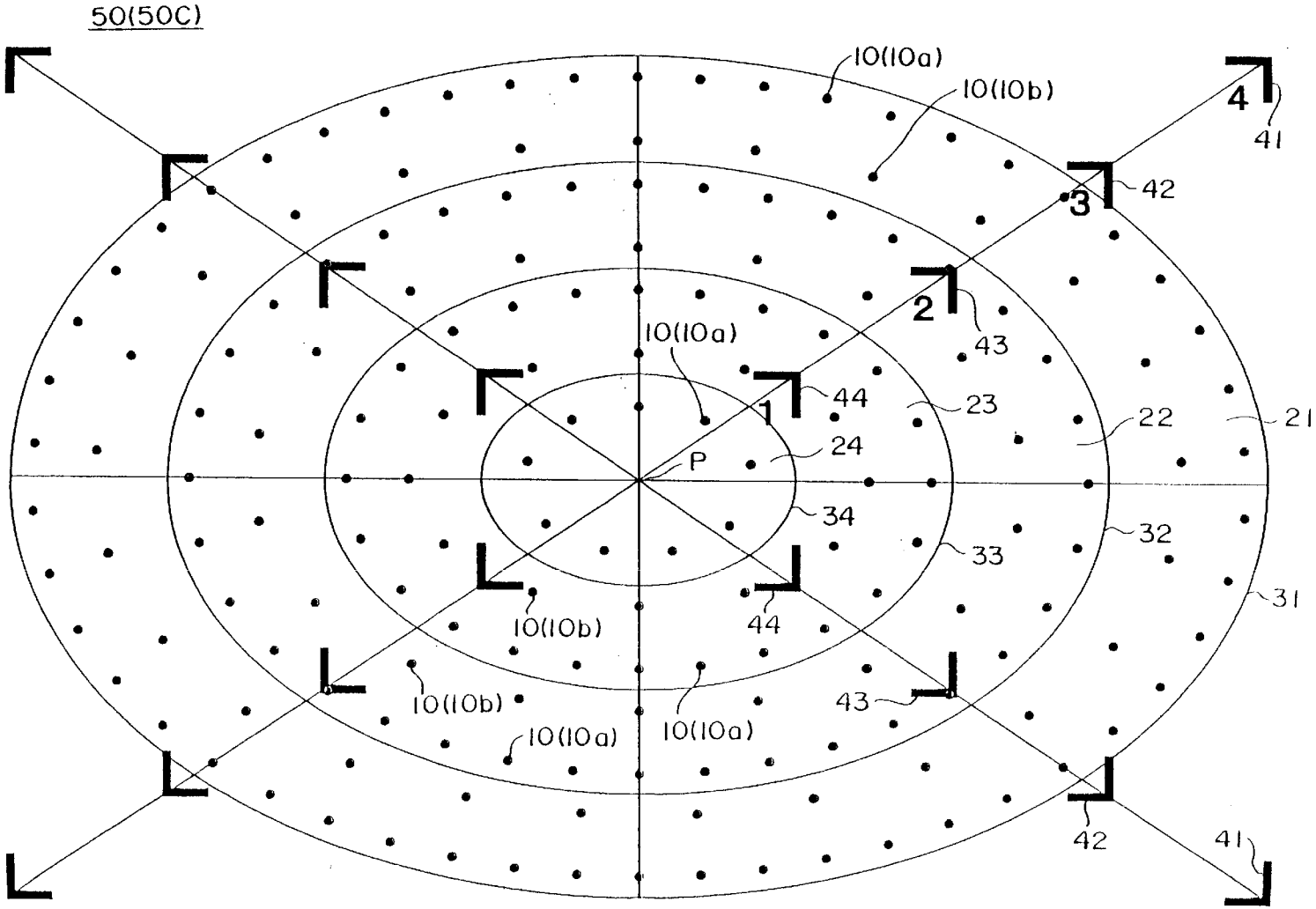
FIG. 3 is a view showing a sheet corresponding to an elliptical damage which is used for a repair work according to one embodiment of the present invention.

While the sheet 50A is suitable for a damaged part whose configuration is similar to a circular shape, in addition to the sheet 50A, the sheet 50 may be exemplified by a sheet 50B shown in FIG. 2 which is to be applied to a damaged part whose configuration is substantially square and a sheet 50C shown in FIG. 3 which is to be applied to a damaged part whose configuration is substantially elliptical. The above described sheet 50B includes first to fourth boundaries 31, 32, 33 and 34 having respectively the round corner parts of the square shapes. Further, points 10*a* in a fourth area 24 are located within a distance of 10 mm inside from the fourth boundary 34. Other structural components are the same as those of the sheet 50A.

The sheet 50C is provided with first to fourth boundaries 31, 32, 33 and 34 which are elliptical in configuration. Further, points 10*a* in a fourth area 24 are located within a range of 7 to 10 mm inside from the fourth boundary 34. Other structural components of the sheet 50C are similar to those of the sheet 50A.

Figure 4:
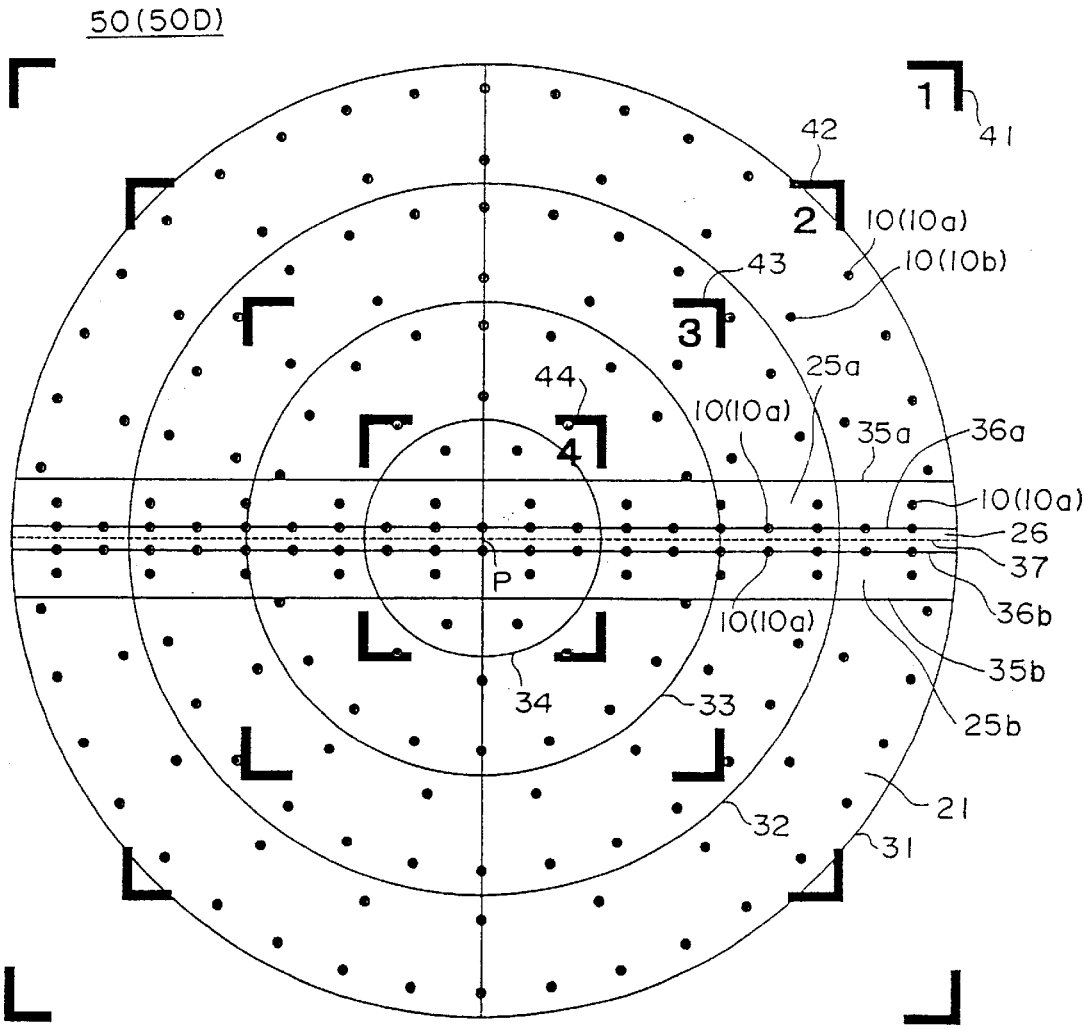
FIG. 4 is a view showing a sheet corresponding to a circular and press line damage which is used for a repair work according to one embodiment of the present invention.
Figure 5:
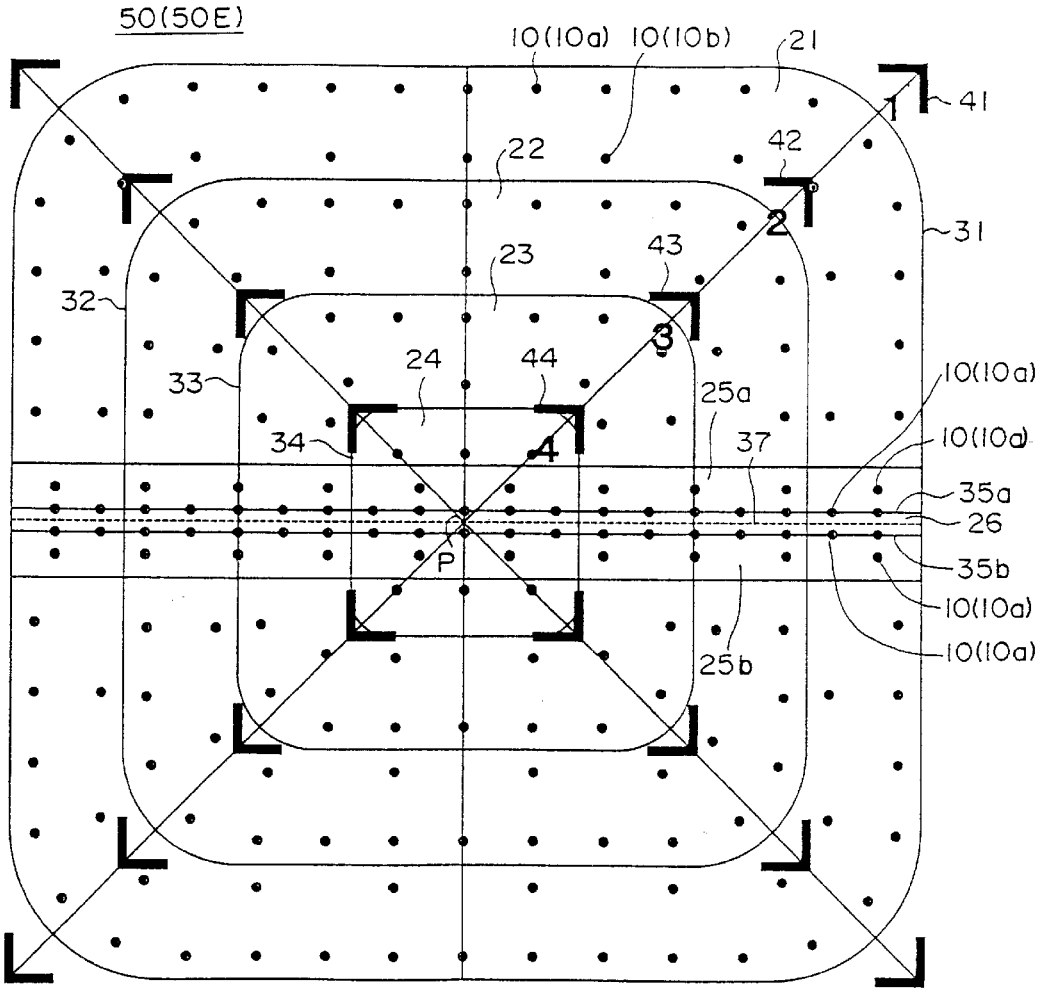
FIG. 5 is a view showing a sheet corresponding to a square and press line damage which is used for a repair work according to one embodiment of the present invention.
Figure 6:
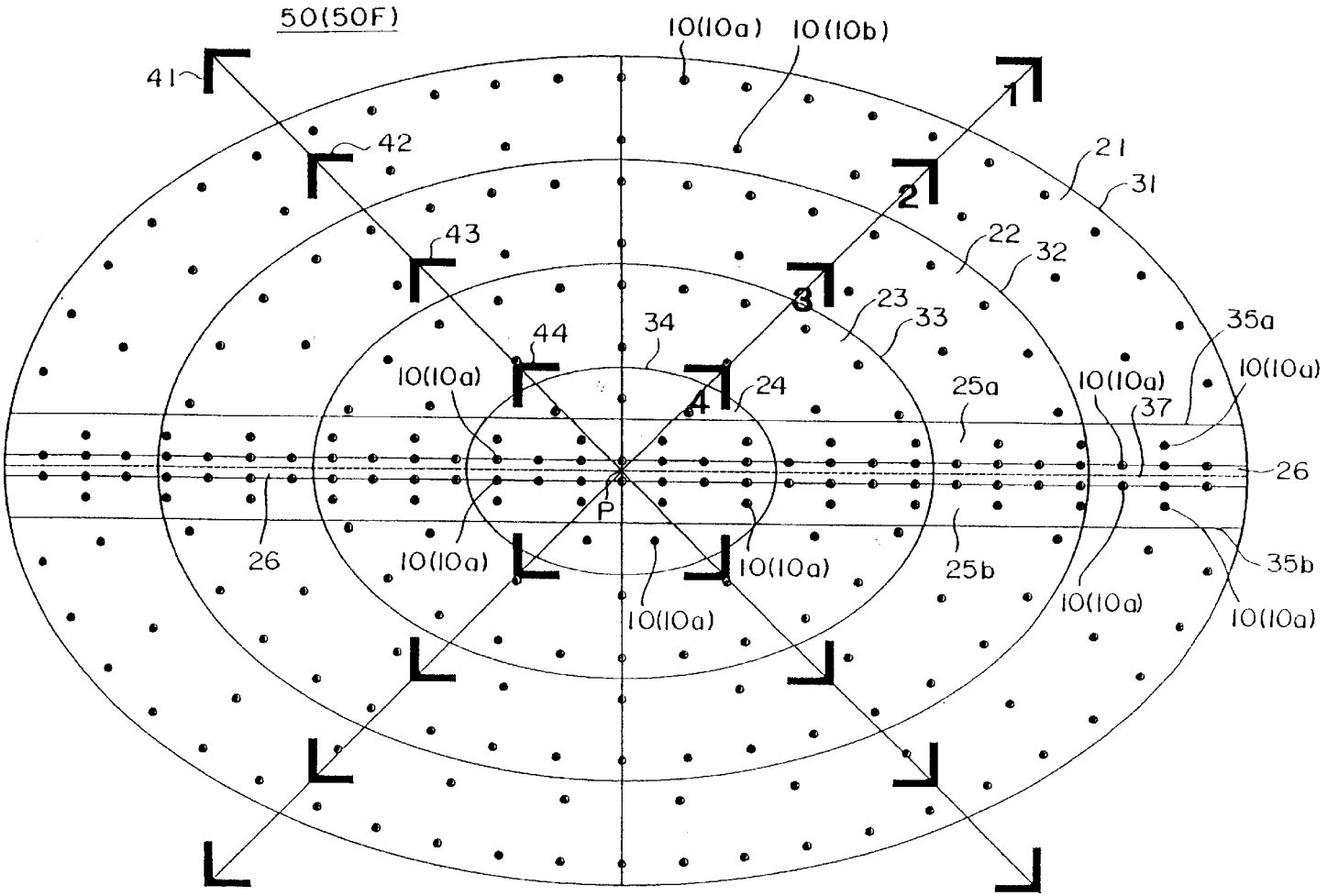
FIG. 6 is a view showing a sheet corresponding to an elliptical and press line damage which is used for a repair work according to one embodiment of the present invention.

Further, in the case where the damaged part extends to a part to which the press line of an outside plate panel is applied, the sheet 50 may be exemplified by a sheet 50D shown in FIG. 4, a sheet 50E shown in FIG. 5 and a sheet 50F shown in FIG. 6, all of which are applied to be a damage of a line.

While the sheet 50D has a structure substantially equal to that of the sheet 50A, a center line 37 shown by a broken line which passes the central point P and extends from the central point P to the boundaries 31 and 31 is formed in the sheet 50D. Further, sixth boundaries 36*a* and 36*b* are formed in parallel with the center line 37 and in the upper and lower parts vertically spaced by 2 mm from the center line 37. Further, fifth boundaries 35*a* and 35*b* are formed in parallel with the sixth boundaries 36*a* and 36*b* and in the upper and lower parts vertically spaced by 10 mm from the sixth boundaries 36*a* and 36*b*. A fifth area 25*a* is formed between the fifth boundary 35*a* and the sixth boundary 36*a*. A fifth area 25*b* is formed between the fifth boundary 35*b* and the sixth boundary 36*b*. Further, a sixth area 26 is formed between the sixth boundary 36*a* and the sixth boundary 36*b*. The fifth areas 25*a* and 25*b* and the sixth area 26, and a first to a fourth areas 21, 22, 23 and 24 may overlap.

On the sixth boundaries 36*a* and 36*b* in the sixth area 26, the first points 10*a* are arranged at prescribed intervals (10 mm). In the fifth areas 25*a* and 25*b*, the first points 10*a* are arranged at prescribed intervals (20 mm) within a prescribed distance (5 mm) inside from the fifth boundaries 35*a* and 35*b*.

On the other hand, the sheet 50E has a structure substantially equal to that of the sheet 50B and is further provided with the structures of the fifth areas 25*a* and 25*b* and the sixth area 26 of the sheet 50D. Also, the sheet 5OF has a structure substantially equal to that of the sheet 50C and is further provided with the structures of the fifth areas 25*a* and 25*b* and the sixth area 26 of the sheet 50D.

[Fixing of Sheet]

Figure 7:
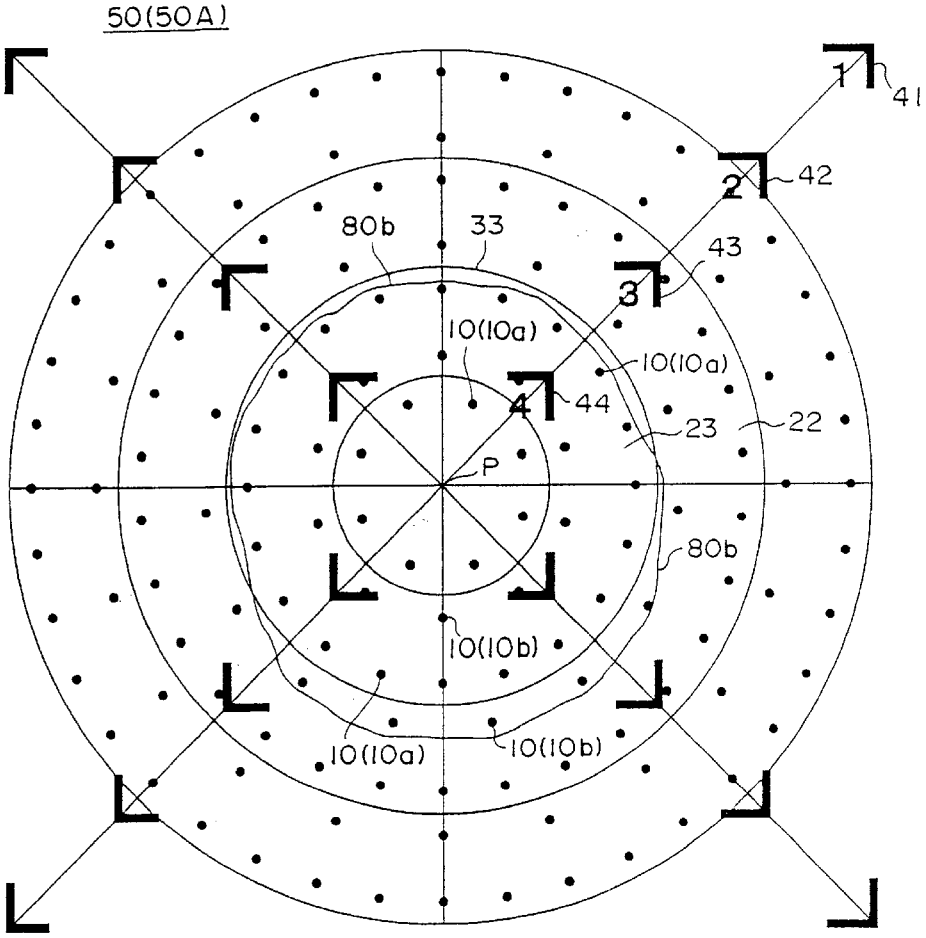
FIG. 7 is a view showing a state that a sheet employed for a repair work according to one embodiment of the present invention is fixed to a damage.
Figure 9:
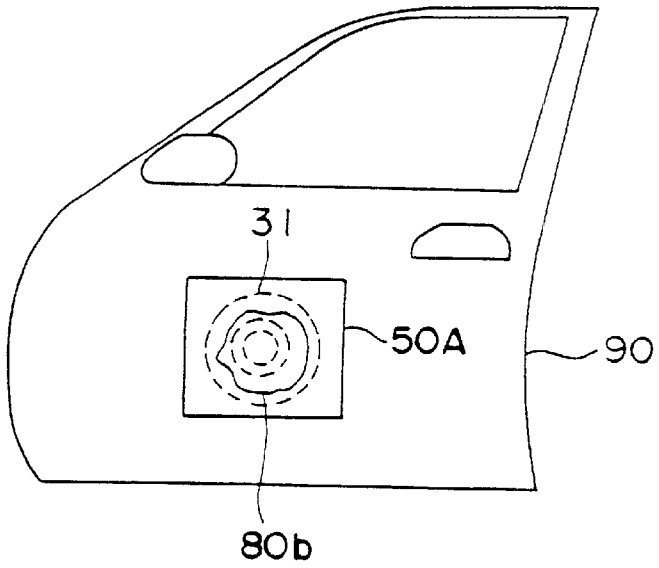
FIG. 9 is a view showing the door panel of a vehicle body to be repaired by a repair work according to one embodiment of the present invention.
Figure 10:
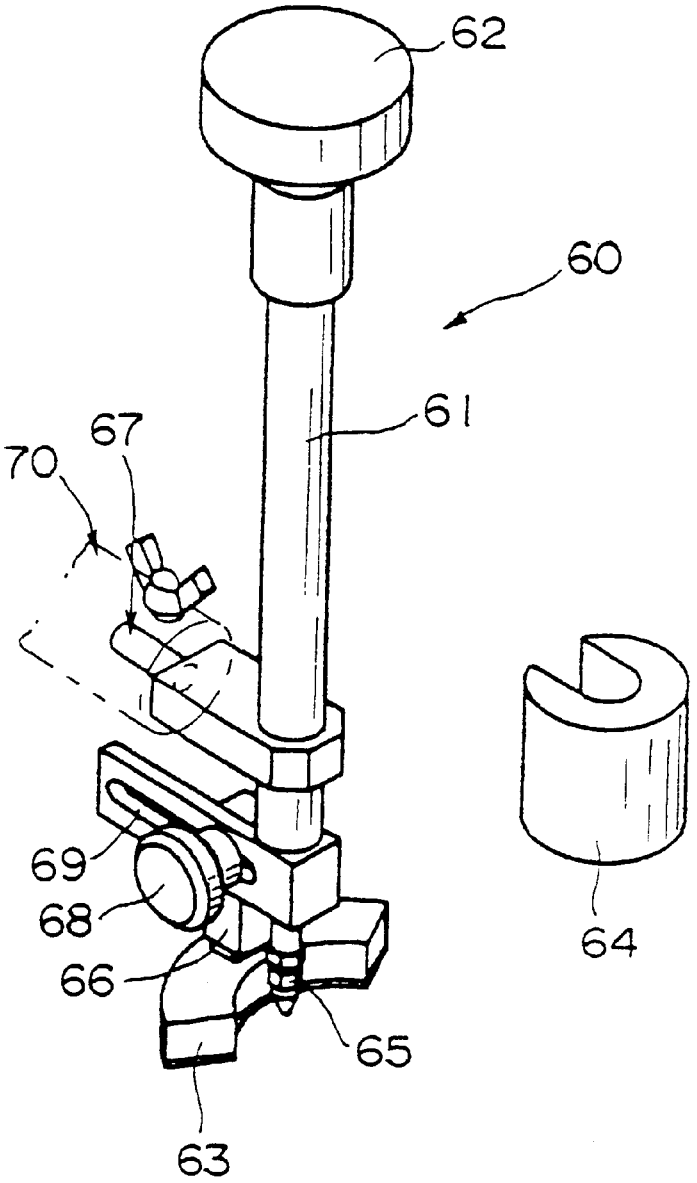
FIG. 10 is a perspective view showing the outline of a puller according to one embodiment of the present invention.

Then, as illustrated in FIGS. 7 and 9, the above described sheet 50A is fixed to the door panel 90 so that the central part (center point P) of the sheet 50A is located on the central part (the deepest part in the dent) of the damage 80*b*. In this case, when the deepest damage is not located in the center of the damage 80*b*, the central part of the sheet 50A may be fixed so as to correspond to the deepest part of the damage. In addition, particularly when the sheet 50 other than the sheet used for a circular damage such as the sheet 50B, the sheet 50C, etc. is employed, the sheet 50 may be fixed to the door panel 90 (vehicle body panel) while the sheet 50 is properly inclined by considering the directional characteristic of the damage. Since the sheet 50 has a back surface to which an adhesive agent is previously applied and the adhesive agent applied surface has a protective sheet stuck thereto, this protective sheet is removed from the adhesive agent applied surface so that the sheet 50 can be stuck to the vehicle body panel. Further, it is not necessary to apply the adhesive agent to all the surface of the back side face of the sheet 50. Then, the sheet 50 may be fixed to the vehicle body panel by using a magnet so as to sandwich the sheet 50 between the magnet and the vehicle body panel.

Further, when the sheet 50D, 50E or 50F for the damage of a press line or the damage of a line is used, for example, the center line 37 of the sheet 50D is aligned with the press line or the line damage formed on the vehicle body to fix the sheet 50D to the vehicle body panel.

[Calculation of Amount of Repair Work]

Subsequently, an operator counts how many the first points 10*a* are present on the sheet 50A located within the damage 80*b* which can be seen through the transparent sheet 50A. Then, the number of the counted first points 10*a* is multiplied by a work area at one point (for instance, 3.14 $cm^2$) so that the total work area can be calculated. At this timer the number of the second points 10*b* located within the damage 80*b* may be also counted and the sum of the first points 10*a* and the second points 10*b* may be multiplied by a work area at one point to calculate the total work area. Further, a work area for each point may be set by taking into consideration a fact that the corrected or repaired positions of the adjacent points may overlap one another. In this connection, there will be described below a reference for determining whether or not to calculate the total work area including the second points 10*b*, or, whether or not to select a work for the second points 19*b*.

Accordingly, materials necessary for a repair work or the like can be grasped on the basis of the total work area thus obtained.

In addition, the number of the first points 10*a* located within the damage 80*b* is multiplied by work time consumed at one point (for instance, 30 seconds, which is set in view of preparation time for a work) to calculate the total work time. Again, the number of the second points 10*b* located within the damage 80*b* may be counted and the sum of the first points 10*a* and the second points 10*b* may be multiplied by the work time consumed at one point to calculate the total work time.

Thus, the repair cost can be calculated on the basis of the total work time thus obtained. For example, the cost of labor per unit time is multiplied by the total work time so that the necessary cost of labor can be obtained. At this time, on the basis of the required quantity of repairing materials as calculated above (the quantity of a putty or a paint), the cost of materials can be also calculated. Still further, on the basis of the total work time, the repair work can be scheduled or the operators can be managed with ease.

Further, the amount of a repair work can be calculated in the following manner. Namely, it is determined which boundary on the sheet 50A the outline of the damage 80*b* is close to. For example, if the outline of the damage 80*b* is close to the third boundary 33, the area of the damage 80*b* will correspond to the third area 23, leading to the value of about 1 $dm^2$. Then, a work area previously set in the third area 23 (the third area 23 and the fourth area 24) is read form a corresponding table or the like which is separately prepared, and then obtained. In a similar manner, work time can be also obtained by reading the damage 80*b* from the corresponding table or the like.

[Coat film Stripping Work]

As a pretreatment of the pulling-out and repair work of the damage 80*b*, a coat film in the damage 80*b* is stripped therefrom.

The stripping work of the coat film is performed in such a manner that each of the first points 10*a* located within the outline of the damage 80*b* is stripped form each position by a hand stroke belt sander or the like. At this time, the end part of the hand stroke belt sander abuts on the door panel 90 or the damage 80*b* through the first points 10*a* to strip the coat film together with the parts of the sheet 50A (the first points 10*a*) on which the belt sander abuts. Consequently, while the sheet 50A is perforated at the positions in the damage 80*b* so as to correspond to the first points 10*a*, the coat film can be stripped points by points. Therefore, there is no need to strip the whole coat film within the damage 80*b*, as is different from a repairing method of the prior art. Specifically, while the coat film within the outline of the damage 80*b* is at least stripped in the prior art method, according to the present invention, the coat film may be stripped at each point 10 inside the outline of the damage 80*b*.

The coat film may be also stripped in the second points 10*b* located within the damage 80*b*.

[Pulling-Out Work]

Next, at the respective parts (corresponding to the first points 10*a*) from which the coat film is removed, the pulling-out and repair work of the damage 80*b* are carried out.

A puller 60 shown in FIGS. 10 to 13 is used to pull out and repair the damage.

Now, an explanation will be given to the puller 60 hereinbelow. The puller 60 comprises a rod shaped main body part 61 and a counter plate 63 connected to the main body part 61 through a connecting part 66. An electrode attachment 67 is attached to the main body 61 so that it can be connected to a welding machine 70 side. Further, at the lower part of the main body part 61 is provided an electrode tip 65 to which an electric current from the welding machines 70 is supplied. The connecting part 66 and the counter plate 63 are rotatably connected with each other in the axial direction passing the electrode tip 65 and the connecting part 66. The space between the connecting part 66 and the counter plate 63, and the electrode tip 65 can be changed by sliding a knob 68 in a slide groove 69. Further, on the upper part of the main body part 61, a grip 62 is provided so as to be easily held by an operator. Further, a hammer 64 is fitted to the main body part 61 so that the main body part 61 is provided with a function as a slide hammer.

Figure 11:
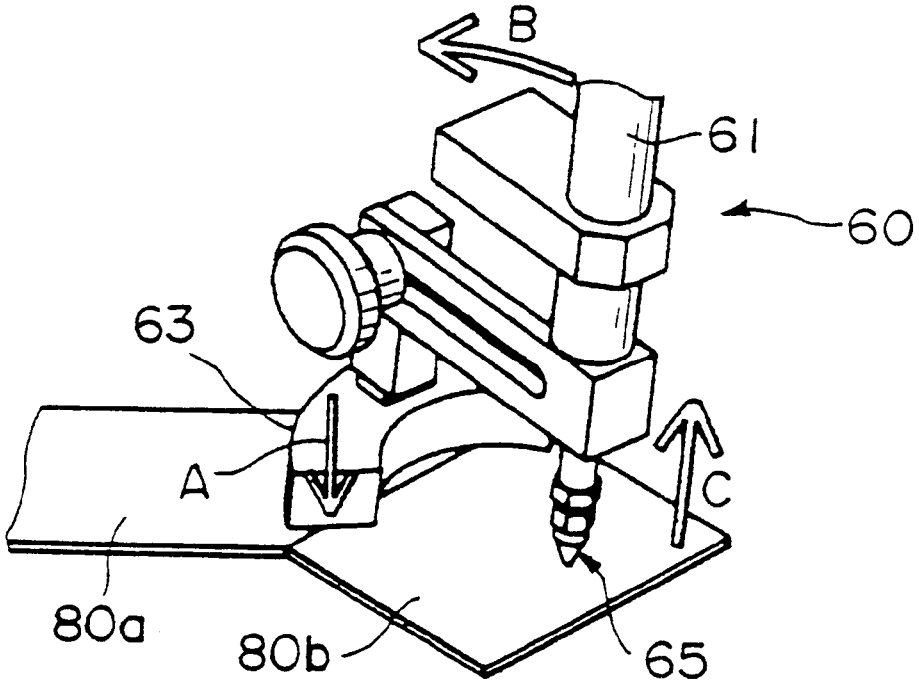
FIG. 11 is a perspective view showing main parts of a puller according to one embodiment of the present invention.
Figure 12:
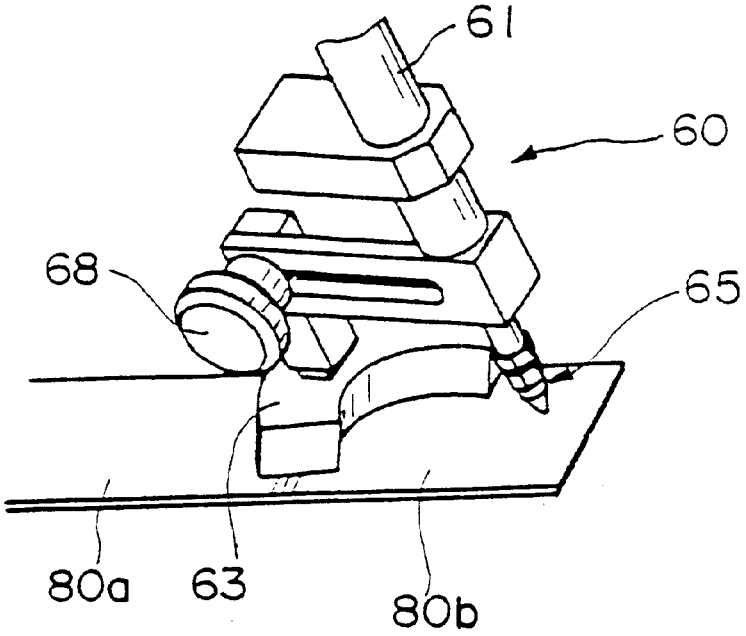
FIG. 12 is a perspective view showing main parts of a puller according to one embodiment of the present invention.

Now, an explanation is directed to the principle of a pulling-out and repair work using the puller 60 having such a structure. In order to recover the damaged panel 80*b* to a state similar to that of a panel 80*a,* the electrode tip 65 abuts on a damaged part desired to be pulled out, as illustrated in FIG. 11, the electric current is supplied thereto, and the end of the electrode tip 65 is welded to the damage 80*b*. Under this state, while the counter plate 63 is pressed downward (in the direction shown by an arrow A), the main body part 61 is pulled forward (in the direction shown by an arrow B). Then, the electrode tip 65 is raised upward (in the direction shown by an arrow C) and the damage 80*b* as well as the electrode tip 65 is pulled out as shown in FIG. 12. In this case, if the fixed position of the knob 68 in the slide groove 69 is changed, the area of the damage 80*b* to be repaired by carrying out a pulling-out work at a time can be changed.

Figure 13:
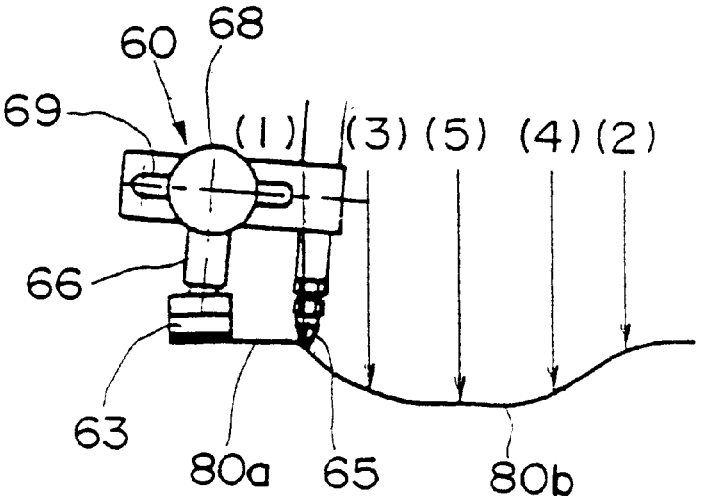
FIG. 13 is an explanatory view for explaining a pulling-out work according to one embodiment of the present invention.

In the pulling-out work on the sheet 50A, the panel is pulled out by the puller 60 successively from the first points 10*a* located in the outer areas to the first points 10*a* located in the inner areas within the damage 80*b* in the order stated above. Referring to FIG. 13, the pulling-out work is carried out at the positions to which the electrode tip 65 is to be welded (the positions in which a pulling-out work is carried out) of points (1), (2), (3), (4), (5) successively in the order stated above. In other words, the pulling-out work is successively carried out from the damage is heavy. The pulling-out and repair works are initially carried out at the position with less damage as described above, so that the positions with less damage are always pulled out in the respective pulling-out points until a repair work is completed. For example, when a pulling-out and repair work is performed in the point (1), the position of the point (3) located inside the point 1 is also raised together therewith. Therefore, a little and simple pulling-out work may be carried out in all-the points.

Although the first points 10*a* located in the same area may be pulled out in any order, the adjacent first points 10*a* may be preferably successively pulled out in an eddy shape as a whole. The pulling-out work can also be carried out in the central point P.

Now, an explanation is given of a determination whether or not the pulling-out work in the second points 10*b* is proper. The second points 10*b* indicate positions in which a pulling-work is supplementarily carried out when the pulling-out work in the first points 10*a* is not sufficient for repair. If the pulling-out work is carried out at all the first points 10*a* and the second points 10*b* located in the damage 80*b* successively from the outside having a shallower dent) to the inside (having a deeper dent) in the order stated above, so that even an unexperienced operator can accurately apply a repair to the damage. However, when the pulling-out and repair work can be more effectively carried out in the first points 10*a* in order to perform the pulling-out work more rapidly, the pulling-out work in the second points 10*b* may be selectively saved.

More specifically, for example, the work can be done in such a way that, after the pulling-out work is finished in the first points 10*a* located outside such as in the first area 21, the pulling-out work is carried out in the second points 10*b* located in the first area 21, and in turn in the first points 10*a* located in the second area 22, in the second points 10*b* located in the second area 22, and the like. Otherwise, after the pulling-out work is finished in the first points 10*a* located in the first area 21, the pulling-out work may be performed in the first points 10*a* located in the second area 22 and then, the same work may be carried out in the second points 10*b* located in the first area 21.

Figure 14:
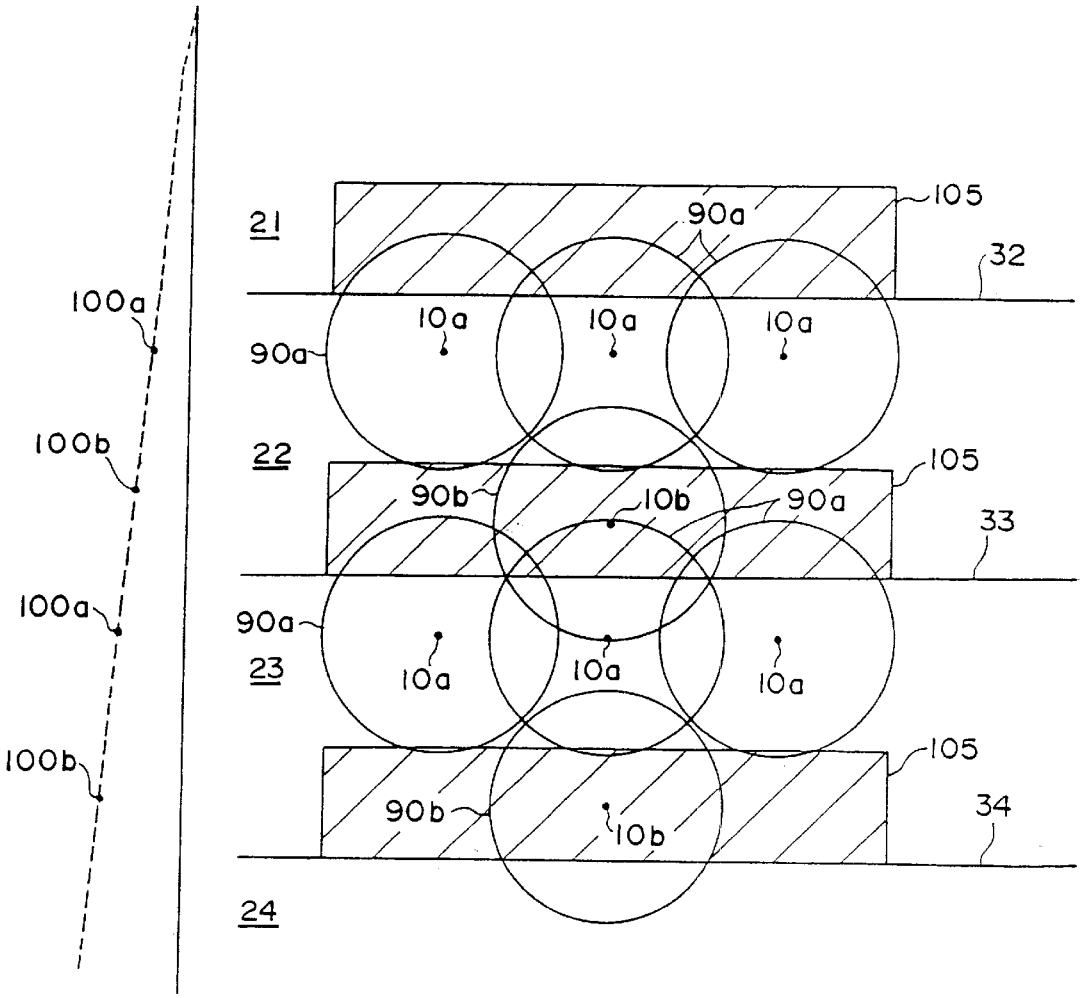
FIG. 14 is an explanatory view for explaining the relation between the pulling-out work and an repair area associated therewith.

Now, referring to FIG. 14, the relation between the pulling-out work in the first points 10*a* and the second points 10*b* and a repair area associated therewith will be in more detail. The right portion in FIG. 14 shows a part of a state that the sheet 50 is stuck to the damaged part of a vehicle body panel. The left portion in FIG. 14 represents the depth of the damage respectively corresponding to parts shown in the right portion.

If a pulling-out work is carried out in the first points 10*a* (100*a* of the vehicle body panel) located in the second area 22 by using the puller 60, the pulling-work in each circle 90*a* will be performed. At this time, assuming that the knob 68 of the puller 60 is set in such a way that the radius of the circle 90*a* as a work area for a pulling-out work is about 1 cm, the work area of the pulling-out work for each time is approximately 3.14 $cm^2$.

When the dent located within the range 105 of the second area 22 is still large after the pulling-out work in the first points 10*a* located in the second area 22 is finished, the pulling-out work is carried out (a pulling-out work in a circle 90*b*) in the second points 10*b* (100*b* of the vehicle body panel) and then is shifted to the pulling-out work of the first points 10*a* located in the third area 23. Thus, the range 105 of the second area 22 can be also desirably repaired. Otherwise, after the pulling-out work in the first points 10*a* of the second area 22, the pulling-out work is performed in the first points 10*a* located in the third area 23. As a result, when the range 105 of the second points 10*b* located in the second area 22 is not desirably repaired, the pulling-out work may be carried out in the second points 10*b* located in the second area.

In this manner, the pulling-out and repair work of the damage 80*b* can be readily done even by an unexperienced operator. An experienced operator can save the supplementary pulling-out work in second points 10*b* as much as possible so that he can repair the damage 80*b* more rapidly.

Further, the pulling-out work in each point may be conducted by welding washers or pins to the vehicle body panel and then, pulling out the washers or pins by means of a pulling-out tool.

Now, an explanation will be directed to a pulling-work suitable for the damage of a press line or the damage of a line. For example, in the sheet 50D whose center line 37 is aligned with and fixed to the press line or the line damage formed on a vehicle body, after the pulling-out work is conducted in the first points 10*a* located in the fifth areas 25*a* and 25*b,* the pulling-out work is carried out in the first points 10*a* (the first points 10*a* one the sixth boundaries 36*a* and 36*b*).

In the case of the damage of a line, the pulling-out work in the fifth areas 25*a* and 25*b* and the sixth area 26 may be carried out initially from the first point 10*a* at any position (preferably, the pulling work may be conducted successively from the point in one end side to the point in the other end side). However, in the case of the pulling-out work corresponding to the press line, in other words, when there are dents generated a dent having depth different from one another throughout a wide range, the pulling-out work in the respective points 10 may be performed successively in such order as the first area 21, the second area 22, the third area 23, the fourth area 24, the fifth areas 25*a* and 25*b* and the sixth area 26 in view of a priority for the positions of pulling-out work. Namely, in this case, the first points 10*a* located in positions where the first area 21 is superposed on the fifth areas 25*a* and 25*b* are pulled out in the positions more precedently to the pulling-out work of the first point 10*a* located in the second area 22.

Particularly, each space between the first points 10*a* located in the sixth area 26 is small, in order to assuredly mend the press line (to facilitate a lining work), and the depth of the damage is frequently large in the damage of a line, so that the deep damage within a small range is certainly repaired.

[Puttying Work]

After the above described pulling-out work, a puttying work is carried out. As a pretreatment of the puttying work, only a part corresponding to the damage 80*b* in the sheet 50A is stripped therefrom and another part on the sheet 50A (part corresponding to a vehicle body panel 80*a*) remains on the vehicle body panel. This is to protect the part which is not damaged so that it is not subjected to a damage under a work thereafter. For example, the boundaries of the sheet 50A may be respectively provided with perforations so that an area inside the boundaries including the damage 80*b* is separated therefrom.

Then, a putty material made of ultraviolet ray polymeric component is embedded in the damage 80*b* as required and the material is cured with ultraviolet ray, so that the damage 80*b* is filled with the putty.

As the ultraviolet ray polymeric components employed as the putty material, components similar to the ultraviolet ray polymeric components generally used as the putty material for a motor vehicle may be used without a special limitation. The ultraviolet ray polymeric component generally employed as such a putty material includes as essential constituents, an ultraviolet ray polymeric prepolymer, an ultraviolet ray polymeric monomer and an ultraviolet ray polymeric initiator, and includes as optical constituents, a sensitizer, a pigment, a filler, a defoaming agent, a surface modifier, a solvent, etc.

The putty material may fill up the damage in a similar manner to a conventional method. In a preferable method, a slightly larger amount of the putty material than a volume of the damage to be filled is applied over a period in several times. At the first time, a suitable amount of the amount of filling is applied to the damaged part with a plastic spatula in such a manner that the putty is rubbed off the spatula onto the damaged part. Further, the rest of the amount of filling of the putty material is divided into suitable portions and is repeatedly applied to the damaged part with the plastic spatula so as to mix in air. The part filled with the putty material is finished in such a way that it swells slightly higher than the original coat film surface. The thickness of the putty material in the part filled with the putty material is larger by approximately 0.1 to 1 mm than the thickness of the original coat film. Accordingly, the thickness of the part filled with the putty material is generally about 0.4 to 3 mm, though depending on the thickness of the original coat film.

After the putty material is applied to the damage, the filled part is irradiated with ultraviolet rays to solidify or cure the putty material as the ultraviolet ray polymeric component. The irradiation of the ultraviolet rays can be carried out by using a device such as a UV lamp for generating lights including the ultraviolet rays. For example, if a component desirable as a putty material is employed, the filling thickness is set within the above described range, and the filled part is irradiated a sufficient quantity of ultraviolet rays, the irradiation time of the ultraviolet rays necessary for curing the ultraviolet ray polymeric component may be fixed to about 30 to 60 seconds.

The putty material is cured by the above ultraviolet rays irradiation. The damaged part to which the pretreatment is applied as required is filled with the putty material. Here, when the volume of the putty material is a little reduced as a result of curing, the expansion of the putty from the original coat film surface may sometimes be slightly decreased as compared. with the swell before solidification.

The surface of the putty swelling higher than the original coat film surface is polished so a to level with the original coat film surface by using a double action sander, an orbital sander or the like. Thus the putty filling process is finished. When a sufficiently smooth surface is not obtained after performing the above putty filling process once, the second putty filling is performed on the putty applied in the first filling process.

[Formation of Primer Surfacer]

Further, on the applied putty, a primer surface layer (primer coat) is formed. At this time, it is desired to form a primer surfacer layer also around the boundary between the putty and the original coat film. More preferably, the primer surfacer layer is formed in such a way that the thickness of the primer surfacer layer is constant and the largest on the putty and in the vicinity of the boundary between the putty and the original coat film and the thickness of the layer is gradually decreased as the distance from the boundary is increased.

The primer surfacer layer is obtained by uniformly spraying a primer surfacer material composed of the ultraviolet ray polymeric component with a viscosity suitable for spraying on an application surface including at least the surface of the putty and by curing a material coat film thus obtained with the irradiation of the ultraviolet rays.

Before the primer surfacer layer is formed, the putty surface and the original coat film surface located in the periphery thereof are preferably cleaned by blowing air and further decreased.

As the ultraviolet ray polymeric component employed for the primer surfacer material, any component can be employed without particular limitation, as long as it is the ultraviolet ray polymeric component having a viscosity which can be uniformly sprayed and maintain a good adhesion between the primer surfacer layer after its solidification and the putty or a finish coat paint formed on the primer surfacer.

[Finish Coat Process]

Before the finish coat (top coat) process, the surface of the primer surfacer layer and the original coat film surface in the periphery thereof may be cleaned by blowing air and further degreased.

The finish coat can be carried out in a similar way to a finishing coat method which is usually carried out in the repair of the paint application surface of a vehicle or the like. For example, a suitable paint application method is selected from a solid painting, a metallic painting and a three-coat mica painting or the like to carry out a paint application so as to match the original coat film. After that a finish process is performed by polishing.

In such a manner, the damage 80*b* of the vehicle body panel can be readily repaired in a short time.

As a result of an experiment, while an average work time required for sheet metal work of a damaged area of $2dm^2$ according to a conventional repair method was 40 minutes. In contrast, according to the repair method of the present invention, the average work time was ten minutes. Further, the average repair work time of all repair work time including the putty work, the surfacer work, etc. for the damaged area of $2dm^2$ was two hours and 30 minutes according to the conventional repair method. On the other hand, according to the repair method of the present invention, the repair work could be done with the average work time of 32 minutes.

It should be noted that the present invention is not limited to the contents of the above described embodiment, and various kinds of modifications can be done by those with an ordinary skill in the art without departing the gist as set forth in the attached claims.

What is claimed is:

1. A sheet for repairing a damaged area of a panel of a vehicle comprising:

points distributed by providing a central part as an origin or a cardinal point; and area display parts for dividing stepwise the points into a plurality of areas from the central part toward outer parts, wherein respective points indicate pulling-out work positions and respective areas indicate the sequence by which the pulling-out work positions are performed on the damaged area of the panel of the vehicle, wherein each of said points is located within a prescribed distance from boundary lines which define the respective areas.

2. A sheet for a vehicle body repair work according to claim 1, wherein said sheet is transparent or translucent.

3. A sheet for a vehicle body repair work according to claim 1, wherein said sheet is provided with fixing means for fixing said sheet to the panel of a vehicle body.

4. A sheet for repairing a damaged area of a panel of a vehicle comprising:

points distributed by providing a central part as an origin or a cardinal point; and area display parts for dividing stepwise the points into a plurality of areas from the central part toward outer parts, wherein respective points indicate pulling-out work positions and respective areas indicate the sequence by which the pulling-out work positions are performed on the damaged area of the panel of the vehicle, wherein each of said points is located within a prescribed distance from boundaries which define the respective areas, and each of said boundaries is formed by a broken line.

* * * * *